United States Patent [19]

Measom

[11] Patent Number: 5,058,881

[45] Date of Patent: Oct. 22, 1991

[54] EXERCISE MACHINE HEIGHT ADJUSTMENT FOOT

[75] Inventor: S. Ty Measom, Logan, Utah

[73] Assignee: Proform Fitness Products, Inc., Logan, Utah

[21] Appl. No.: 482,209

[22] Filed: Feb. 20, 1990

[51] Int. Cl.[5] ..... A63B 23/06

[52] U.S. Cl. ..... 272/69; 248/188.2

[58] Field of Search ..... 272/96, 69, 97, 105, 272/93; 248/188.2, 649, 157

[56] References Cited

U.S. PATENT DOCUMENTS

| | | | |
|---|---|---|---|
| 2,281,769 | 5/1942 | Hochriem | 248/649 |
| 3,338,539 | 8/1967 | Foster | 248/188.2 |
| 4,068,815 | 1/1978 | Losert | 248/188.2 |
| 4,591,147 | 5/1986 | Smith et al. | 272/69 |
| 4,729,558 | 3/1988 | Kuo | 272/69 |
| 4,749,181 | 6/1988 | Pittaway et al. | 272/69 |
| 4,759,540 | 7/1988 | Yu et al. | 272/69 |
| 4,776,582 | 10/1988 | Ramhorst | 272/69 |
| 4,792,134 | 12/1988 | Chen | 272/69 |

*Primary Examiner*—Stephen R. Crow

*Attorney, Agent, or Firm*—Trask, Britt & Rossa

[57] ABSTRACT

An apparatus for elevating an object to a selectable preset height, which comprises the use of a set of feet mounted off-center on an axle. The feet may be rotated to provide a set of unique, selectable preset heights, and is particularly useful for changing the slope of a treadmill type exercise machine.

9 Claims, 3 Drawing Sheets

EXERCISE MACHINE HEIGHT ADJUSTMENT FOOT

BACKGROUND OF THE INVENTION

1. Field

This invention relates to exercise machines such as treadmills, and more particularly to means for adjusting the endless belt surface of the treadmill to operate at differing preset slopes.

2. State of the Art

Exercise machines commonly known as treadmills are widely used for walking, jogging and running exercises. An endless belt moves on a track between two pulleys at a variable controlled speed typically between 0.5 and 6 miles per hour. The exercising person walks, jogs or runs at a speed matching the belt speed, to maintain a stationary position relative to the machine.

Treadmills typically include means to adjust one or both of belt speed and angle of inclination or slope to select a wide range of exercise difficulty. The slope or inclination may typically be varied between horizontal and a grade of 5 to 10 percent.

Various means are currently used for raising one end of the treadmill to achieve the desired angle of inclination. U.S. Pat. No. 4,759,540 (Yu et al.) discloses several scissor-jack arrangements for elevating the front end of a treadmill. A screwed rod with two oppositely threaded portions is rotated within two nuts to change their horizontal distance and raise the treadmill.

U.S. Pat. No. 4,792,134 (Chen) discloses a slope adjustment means comprising a shaft rotated by an electric motor through a gear arrangement, to pivotably raise or lower a pair of legs.

U.S. Pat. No. 4,749,181 (Pittaway et al.) describes a treadmill with an electrically driven slope changing apparatus. Nuts are rotated on vertical non-rotating screws to change the elevation.

U.S. Pat. No. 4,776,582 (Ramhorst) shows an exercise treadmill which uses a swing frame with a vertically adjustable pivot axis. The swing frame is pivoted forward to a position where opposed trunnions may be inserted into spaced cutouts to vary the height. The apparatus is relatively complex to fabricate, and thus expensive.

The foregoing patents describe relatively complex devices for adjusting the slope of the treadmill. Two of the machines use an electrical motor and are thus relatively expensive. None of the prior art devices easily or simply achieve several accurately preset angles of inclination or slope.

SUMMARY OF THE INVENTION

Apparatus for adjusting the elevation of an object has foot means for supporting the object on a surface. The foot means has an axle aperture and surface means for contact with the supporting surface. The surface means has portions each spaced at a different distance from the axle aperture. The axle is attached to the object and mechanically associated with the axle apertures for rotation of the surface means relative to the supporting surface. Spring means is preferably interconnected between the axle and foot means to urge the foot means to rotate relative to the supporting surface.

The portions of the surface means may form an arcuate surface which in projection is a locus each point of which is a different radius from the axle aperture. In another embodiment, the surface portions may form a polygon in projection.

The apparatus may also include locking means to lock the foot means relative to the object. The locking means is preferably a plurality of apertures in the foot means positioned to register with an aperture in the object to be elevated.

In an alternative embodiment, the foot means may have multiple support surfaces for contact with a surface. The height is adjusted simply by rotating the foot means through less than a complete revolution about an axle. The axle is positioned in an axle aperture which is formed in the foot means with a different distance from the aperture to each support surface.

The foot means preferably is two spaced-apart feet, each desirably formed to be a polygon in projection or axial cross-section. The object may have two spaced-apart sides. The axle has opposite ends, each mounted to and between the opposite sides. The foot means are thus rotatable with or about the axle between a first configuration with a first support surface in contact with the surface and a second configuration with the second support surface in contact with the support surface.

In alternate embodiments, the spaced-apart feet are the same and have three, four, five or six support surfaces. In yet other embodiments, the support surfaces may be substantially planar or two lobal surfaces. Desirably, the feet are polygons in axial cross-section each with equilateral sides. In another configuration, the support surface may have a friction surface associated therewith.

BRIEF DESCRIPTION OF THE DRAWINGS

In the drawings which illustrate what is presently regarded as the best modes for carrying out this invention.

DETAILED DESCRIPTION OF THE PREFERRED EMBODIMENT

Figure 1:
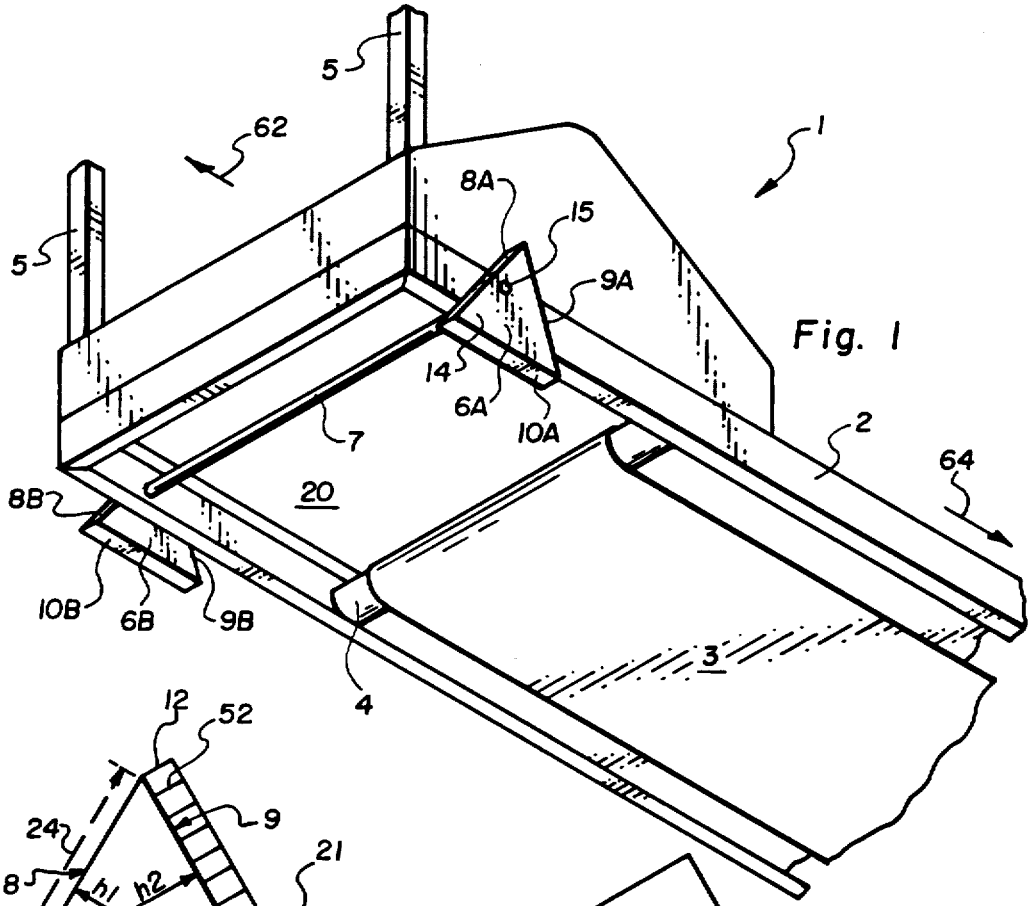
FIG. 1 is a perspective view of a portion of the underside of an exercise machine showing one embodiment of the apparatus of the present invention.

FIG. 1 shows an exemplary treadmill type exercise machine 1 with a base frame 2. A front pulley 4 and a rear pulley, not shown, support an endless belt 3 which is moved by a motor not shown. Supports 5 are attached to frame 2 to extend upwardly to a handle not shown. The handle may be held by the user for stability during operation.

In FIG. 1, a set of two upright polygonal feet 6A and 6B are mounted on axle 7. The feet 6A and 6B are each positioned outside the frame 2. In alternate arrangements, the feet 6A and 6B may be sized and positioned inside or interior 20 the base frame 2.

The axle 7 is attached to each foot 6 at an axle aperture or locus 15 (FIG. 2) which is off-center. That is, the aperture 15 is not centrally disposed in the foot 6, but rather located a different distance (h1, h2 and h3) from each support surface such as surfaces 8, 9 and 10. Each support surface 8, 9 and 10 of foot 6 is for positioning on a floor or similar surface. The distances h1, h2 and h3 are shown as the shortest distance to the surface from the axle aperture 15 and may be seen here as a normal height or distance from their respective surfaces.

Figure 2A:
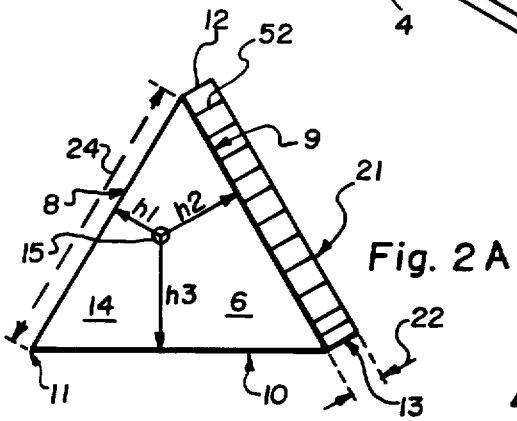
FIGS. 2A and 2B are perspective views of the embodiment of the foot means of the instant invention.
Figure 2B:
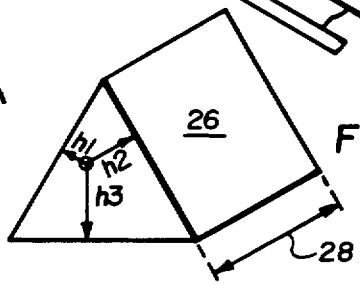

In FIG. 2, triangular foot 6 is shown in more detail with two planar and opposite sides 14 and 21. The foot 6 thus has a thickness 22 which is selected as desired from about 1 to about 3 inches. Support surfaces 8, 9 and 10 are shown normal to the vertical side 14, and are joined at connecting corners 11, 12 and 13. The axle 7 is mounted at locus 15, resulting in a distance from the locus 15 to plane 8 of h1, a distance of h2 to plane 9 and a distance to plane 10 of h3. The axle 7 is rotatably mounted at the locus 15 off-center so that h1, h2 and h3 are all different or unequal. The particular off-center locus 15 to use for achieving a particular set of h1, h2 and h3 may be easily found by plotting an equilateral triangle to enclose the desired height vectors. The total of h1, h2 and h3 equals the total triangle height. The distances h1, h2 and h3 are always different and always less than the combined length 24 of the support surfaces 8, 9 and 10, such as length 24.

Figure 3:
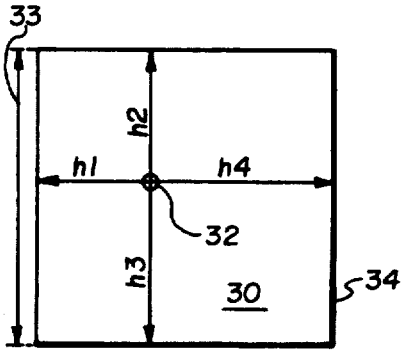
FIG. 3–5 are side views of three embodiments of this invention, in which the height is adjustable through four, five, and six preset levels, respectively.
Figure 4:
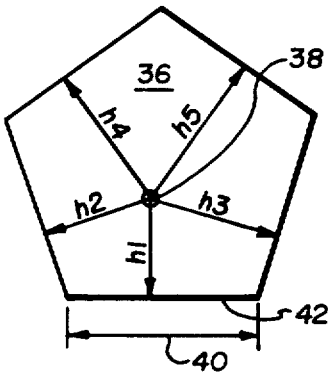

Referring now to FIG. 3, a rectilinear (in cross-section) foot 30 is shown with its axle aperture 32 positioned so that each height h1, h2, h3 and h4 is different and never larger than the length 33 of any side 34. Similarly, foot 36 of FIG. 4 is pentagonal in cross-section with its axle aperture 38 positioned so that each distance h1-h5 is different and less than the length 42 of any support surface 42 each of which are of the same length as shown.

Figure 5:
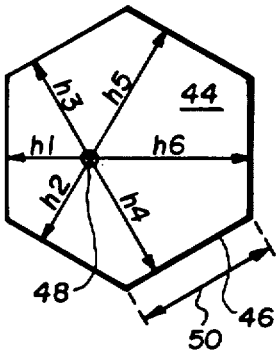
Figure 6:
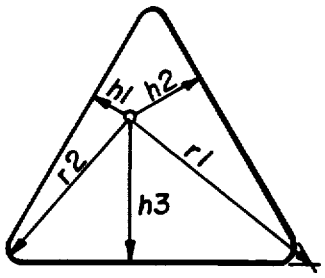
FIGS. 6–9 are side views of four additional embodiments of the foot means of the invention.
Figure 7:
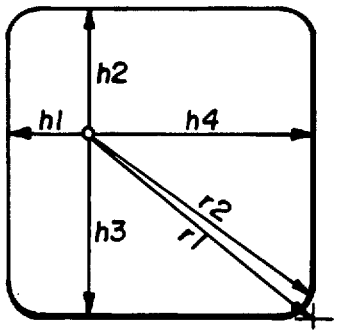
Figure 8:
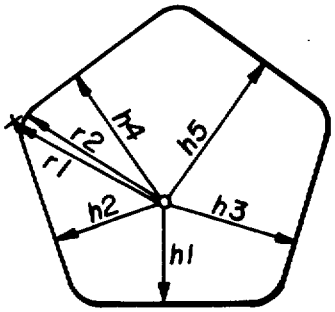
Figure 9:
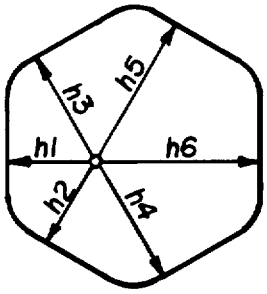
Figure 10:
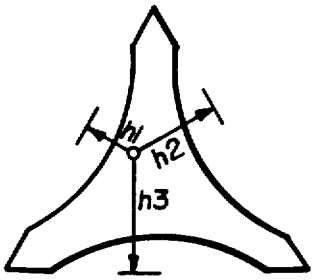
FIGS. 10–13 are side views of four additional embodiments of the foot means of the invention.
Figure 11:
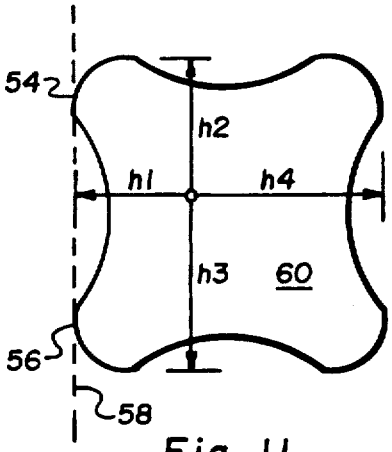
Figure 12:
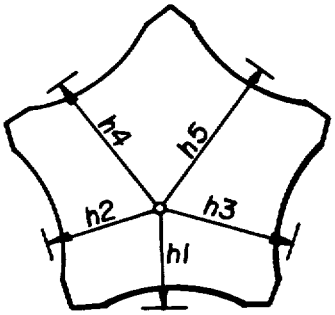
Figure 13:
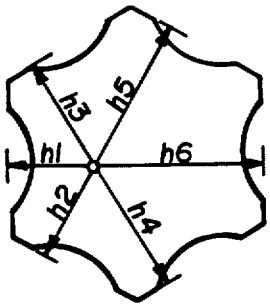

Foot 44 of FIG. 5 is hexagonal in cross-section with equilateral sides 46. The axle aperture 48 is positioned so that each distance h1-h6 is different. Notably, in FIG. 6, distance h5 is virtually the same as the length 50 of a side 46 and distance h6 is larger than the length 50 of side 46. In the other disclosed configurations (FIGS. 2-4), the length of their sides is less than the largest height h so that the feet will provide greater stability. That is, a greater effective force must be applied at the axle aperture 15, 32, 38 to cause rotation of the foot 10, 30, 36 than when the distance is greater than the length of the side as distance h6 in FIG. 5.

With feet having four, five, six or more support surfaces, the procedure for determining the foot size from the required heights h1, h2, h3, h4 and so on uses trigonometry similar to that discussed with respect to FIG. 2.

The axle 7 of FIG. 1 may be fixedly mounted on exercise machine such as treadmill 1 or on another object; and each foot 6 may be mounted to be separately or jointly rotated on the axle 7 as desired. In another embodiment, axle 7 may be free to rotate relative to treadmill 1 with the feet fixedly secured to the axle 7. In this embodiment, the feet 6 are to freely rotate on the axle 7. Preferably, however, the axle 7 and opposing feet 6 are fixedly attached so that rotating one foot 6A to a desired support surface will simultaneously and uniformly rotate the other foot 6B to the same plane.

While the invention may be used simply by rotating the foot 6 by hand, it may be adapted to be turned merely by forward 62 or reverse movement 64 of the exercise machine. In this mode, the feet turn like wheels on the floor as the machine is moved. In order to enhance the ease of such rotation, the corners of the polygonal feet may be rounded to reduce the effective "wheel radius". Such is illustrated in FIGS. 6-9 wherein r2 is shorter than r1. For rotating the feet in this manner, the support surfaces are formed to provide a high coefficient of friction with the floor. That is, the surfaces may be coated with an abrasive or have gripping slots 52 (FIG. 2), or the like.

The further embodiments shown in FIGS. 10-13 are similar to FIGS. 2-5 and 6-9. However, the central portion of each support surface is removed to result in two separated lobal support surfaces 54, 56 within the same support surface plane 58. This results in a foot 60 which provides better support on a non-level surface. In addition, the weight of the foot 60 is reduced without reducing the range of adjustability.

Figure 14:
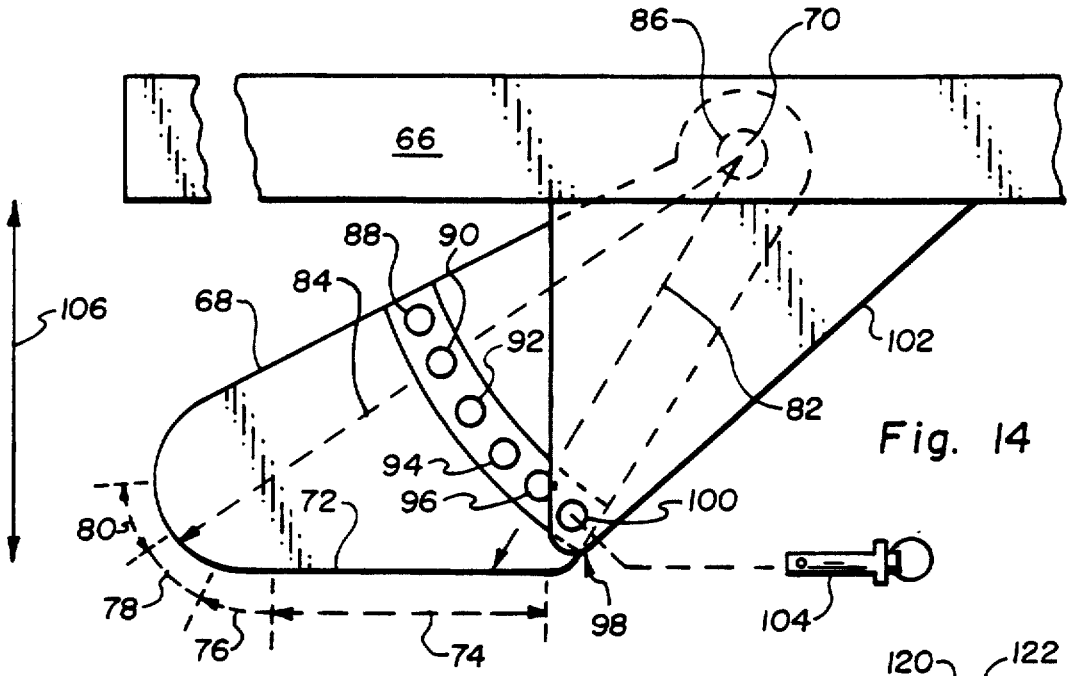
FIG. 14 is a partial side view of a portion of a treadmill with a foot of the invention.

In FIG. 14, the frame 66 of a treadmill is partially shown with a foot 68 rotatably secured to the frame 66 by an axle 70 journaled to the frame 66 such as by an aperture (not shown) in the frame. The frame 66 is rectilinear similar to the frame 2 of FIG. 1. The foot 68 is shown positioned proximate the left side of the frame. Another foot is positioned proximate the right side but is not here shown.

The foot 68 of FIG. 14 has surface means for supporting the treadmill on a surface. The surface means is the lower exterior perimeter 72 of the foot 68. The lower perimeter 72 has portions, for example, portions 74, 76, 78 and 80, which are each spaced at a different distance 82 or 84 from the axle aperture 86. The portions, such as portions 74, 76, 78 and 80, may be short or small or long. Indeed, they form a locus in projection in which each point of the locus is at a different distance or radius 82, 84 from the axle aperture 86.

The foot 68 of FIG. 14 also has a series of apertures 88, 90, 92, 94, 96 and 98 which are formed to register with aperture 100 formed in extension member 102 The extension member 102 is secured to the frame 66 of the treadmill. A pin 104 is provided for insertion through aperture 100 and a selected aperture 88, 90, 92, 94, 96 and 98. The selection of a desired aperture is effected by rotating the foot 68. The aperture selected positions a different portion of the surface means for contact with the surface upon which the treadmill is positioned. Since the distance to each portion such as portions 74, 76, 78 and 80 varies, the height 106 of the treadmill at one end is thereby adjusted and, in turn, the incline. The extension member 102 may have a plurality of apertures in addition to those in the foot to provide for a greater number of height or incline selections. Of course, the foot 68 may have only one aperture; and the extension member 102 may have a plurality of apertures if desired.

Figure 15:
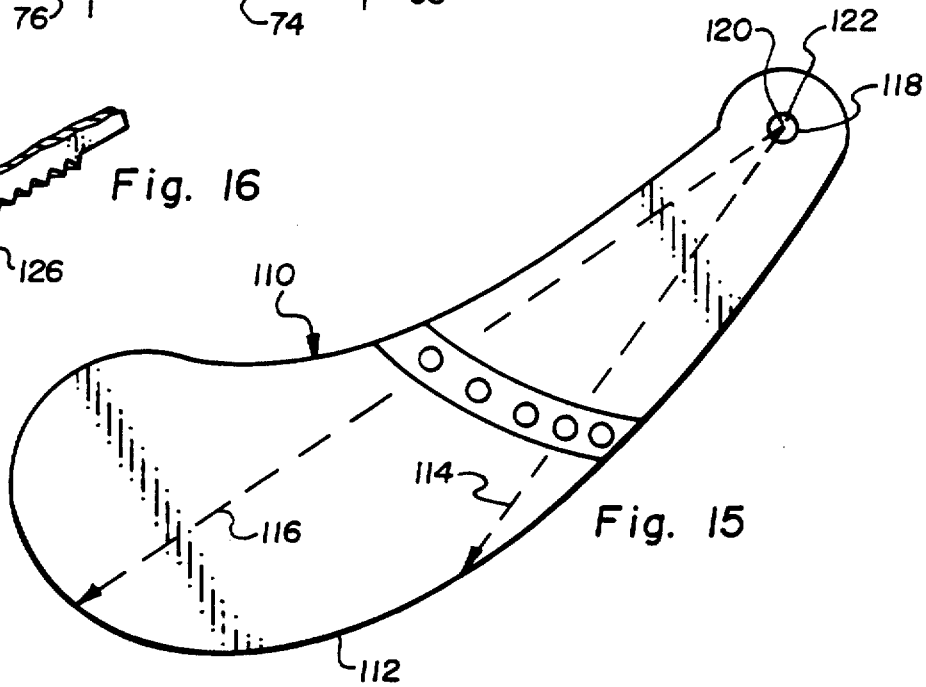
FIG. 15 is a side view of an alternate foot of the invention.

FIG. 15 depicts an alternate construction of a foot 110 in which the surface means is arcuate perimeter 112. The individual portions of the surface means are such that the surface 112 in projection is a locus each point of which is a different distance 114, 116 from the axle aperture 118 and the axis 120 of the axle 122.

It may be understood that the foot 68 is a left foot. A similar right is provided for the right side of the frame 66 (not shown). The left foot 68 and the right foot may move independently on the axle 70 so that each foot may be separately adjusted to accommodate uneven support surfaces. Alternately, each may be keyed to the axle 70 to rotate together.

Figure 16:
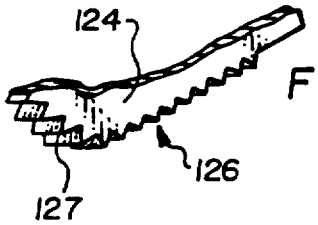
FIG. 16 is a partial, cutaway portion of a of a foot of the invention.

In FIG. 16, a cutaway 124 portion of a foot such as foot 68 and 110 is shown with the supporting surface 126 being formed with a plurality of slots or corrugations 127 to act as a friction surface. In use, a friction surface is desired so that the user may rotate the foot 68, 110 and the feet of FIGS. 2–13 by pushing or urging the supported object such as treadmill 1 of FIG. 1 forwardly 62 or rearwardly 64.

Figure 17:
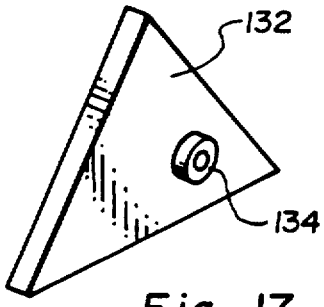
FIG. 17 is a perspective view of a foot with a spring housing connected thereto.
Figure 18:
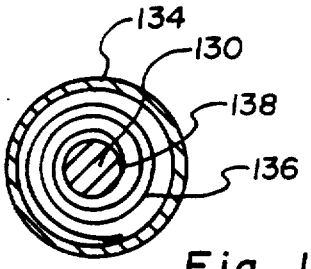
FIG. 18 is a cross-section of the spring housing of FIG. 17.
Figure 14:
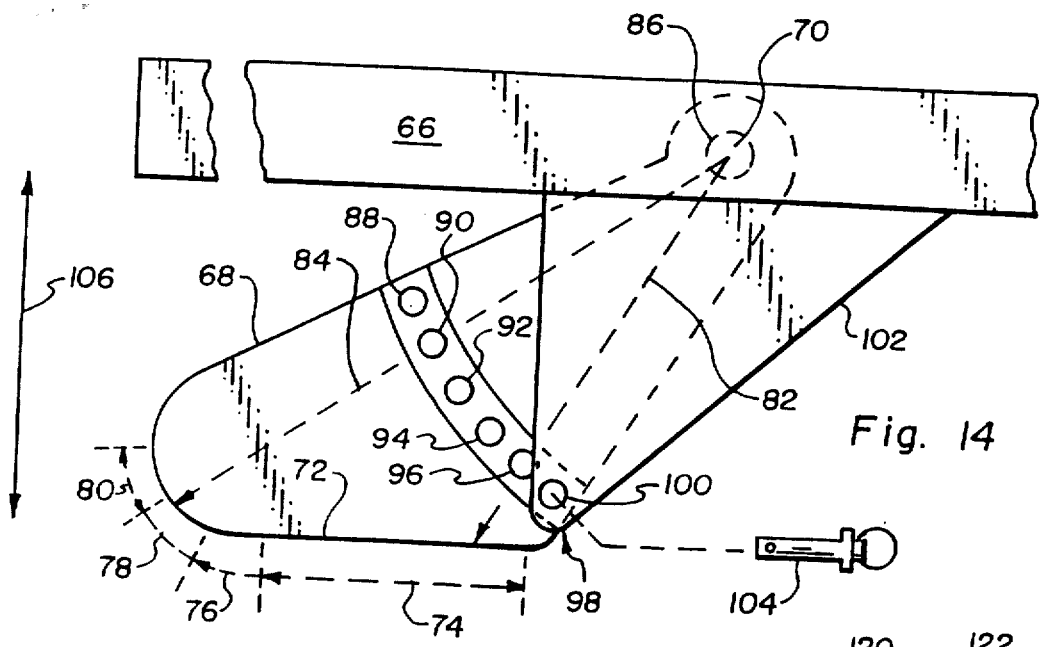
Figure 16:
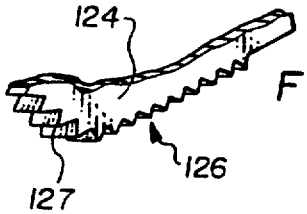
Figure 15:
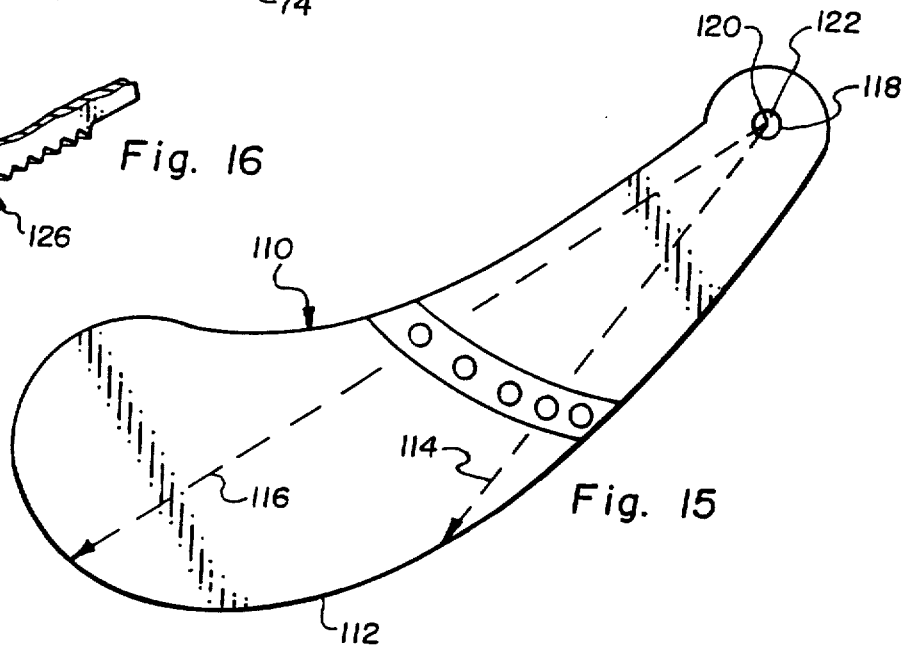
Figure 17:
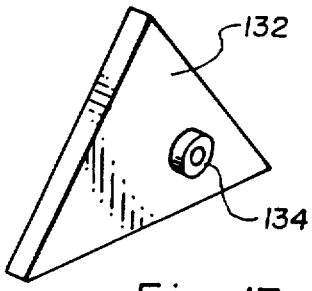
Figure 18:
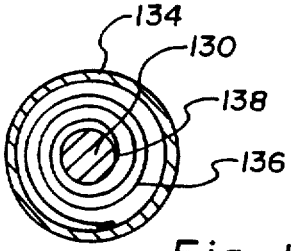

To assist in rotating the feet, a spring arrangement may be interconnected between the axle 130 and the foot 132 as shown in FIGS. 17 and 18. That is, a foot, such as foot 132, may have a spring housing 134 adapted thereto or formed as a part thereof. The housing 134 is positioned so that the axle 130 may be inserted in the axle aperture of the foot 132.

A clock spring 136 is secured at one end 138 to the axle and at its other end to the housing 134. The spring is wound or pretightened to assist in rotating the foot 132 to position the object such as the treadmill at a greater height or larger angle of inclination. Upon return to a lower height, the spring may be wound to be ready to assist in movement to a greater height. Other spring configurations may be used to assist in elevating the object preferably with the use of a locking means such as the pin 104 with apertures 90, 92, 94, 96, 98 and 100 as shown in FIG. 14.

Obviously, many modifications and variations of the invention herein set forth can be made without departing from the scope and spirit thereof, and only the limitations indicated in the appended claims should be imposed.

What is claimed is:

1. Apparatus for elevating an object, said apparatus comprising:

foot means for supporting an object on a surface, said foot means having an axle aperture formed therein and surface means for contact with said surface, said surface means having portions thereof each spaced at a different distance from said axle apertures, said portions of said surface means forming an arcuate surface which in projection is a locus, each point of which has a different radius from said axle aperture;

an axle attached to said object and mechanically associated with said axle aperture for rotation of said surface means relative to said surface; and locking means associated with said foot means and said object for locking said foot means relative to said object with a selected portion of said surface means in contact with said surface, said locking means including:

a stationary aperture formed in said object, a plurality of foot means apertures formed in said foot means for positioning in alignment with said stationary aperture, said foot means apertures and said stationary aperture equidistant from said axle aperture, and pin means for insertion into selected apertures of said foot means apertures and said stationary aperture.

2. The apparatus of claim 1 wherein said foot means includes two spaced-apart feet.

3. The apparatus of claim 2 wherein selected of said portions surface means are formed to be a friction surface.

4. The apparatus of claim 1 further including spring means interconnected between said foot means and said axle to urge said foot means to rotate relative to said object.

5. The apparatus of claim 1 wherein said foot means is rotatable between a first lockable configuration with one support surface portion in contact with said surface and a second lockable configuration with another support surface portion in contact with said surface.

6. The apparatus according to claim 2, wherein said object has spaced-apart sides, wherein said axle has opposite ends secured to and between said spaced-apart sides, and wherein said foot means is rotatably secured to said axle each said foot proximate an opposite end thereof.

7. The apparatus of claim 6 wherein said foot means is rotatable between a lockable position whereby said object is fully elevated and a lockable position whereby said object is non-elevated, wherein said rotation between said fully elevated position and said non-elevated position comprises an angle about said axle less than 60 degrees.

8. The apparatus of claim 7, wherein said object is an exercise machine.

9. The apparatus of claim 4, wherein said spring means is a clock spring within a spring housing and pretightened to urge said object to a higher elevation.

* * * * *

UNITED STATES PATENT AND TRADEMARK OFFICE
CERTIFICATE OF CORRECTION

PATENT NO. : 5,058,881

DATED : October 22, 1991

INVENTOR(S) : S. Ty Measom

It is certified that error appears in the above-identified patent and that said Letters Patent is hereby corrected as shown below:

Col. 2, line 53 after "of a" (1st occurrence) insert ---support surface---.
Col. 4, line 44 after "102" insert a ---. (period)---.

Col. 6, line 38 "6" should be ---1---.
Col. 6, line 45 "7" should be ---1---.

One Sheet of drawings (FIGS. 14-18) is missing from the patent. (attached hereto)

Signed and Sealed this

Twentieth Day of July, 1993

*Attest:*

Michael K. Kirk

MICHAEL K. KIRK

*Attesting Officer*

*Acting Commissioner of Patents and Trademarks*